US005377945A

United States Patent [19]

Steinke

[11] Patent Number: 5,377,945

[45] Date of Patent: Jan. 3, 1995

[54] MOUNT FOR REDRESSABLY MOUNTING A SIGN

[76] Inventor: Michael E. Steinke, Rte. 2, Box 8, Hope, N. Dak. 58046

[21] Appl. No.: 165,197

[22] Filed: Dec. 13, 1993

[51] Int. Cl.[6] ..... E04G 3/00

[52] U.S. Cl. ..... 248/292.1; 40/608; 40/612; 248/364; 248/900; 404/10

[58] Field of Search ..... 248/292.1, 293, 299, 248/291, 364, 900, 417, 548; 40/608, 606, 612; 404/9, 10

[56] References Cited

U.S. PATENT DOCUMENTS

| | | | |
|---|---|---|---|
| 1,856,349 | 5/1932 | Bigelow | 40/613 |
| 3,851,616 | 12/1974 | Brown | 40/612 X |
| 3,960,067 | 6/1976 | Dutchburn | 248/364 X |
| 4,957,258 | 9/1990 | Tiedemann | 40/608 X |
| 5,230,174 | 7/1993 | Reed | 248/291 X |

*Primary Examiner*—Ramon O. Ramirez
*Attorney, Agent, or Firm*—David A. Lingbeck

[57] ABSTRACT

This invention relates to a mount for redressably mounting a sign thereupon comprising a bracket member fixedly attached to an end of an elongate support member having essentially an angled cross section. The bracket member is mounted to a structure such as a bridge with the support member disposed generally horizontal relative to the ground such that the vertex is directed downward to display essentially a V shape. A tubular rotatable member having a square cross section is coaxially and rotatably mounted about the support member with a weighted pendulum swingably depending downwardly from the bottom wall of the rotatable member and with a sign support member extending upwardly from the top wall thereof to which a sign is fixedly attached. The support member provides two pivot points upon which the rotatable member rests with the sign in an upright position to substantially minimize swaying of the sign back and forth in the wind. The rotatable member rotates upon the support member in response to the sign being impacted by external forces and returns in a resting position with the sign in an upright position when there are no external forces.

9 Claims, 5 Drawing Sheets

MOUNT FOR REDRESSABLY MOUNTING A SIGN

BACKGROUND OF THE INVENTION

This invention relates to a mount for redressably mounting a sign such as a bridge marker and the like to substantially prevent bridge markers as such from being broken off upon impact with structures or vehicles crossing over the bridges.

Sign mounts, stands, posts, and the like are well known in the art; wherein, the mounts, stands, and posts are mostly spring loaded to spring back upon impact or have flexible resilient means to flex and reflex back into a resting upright position after impact. These mounts, stands, and posts generally become brittle and rigid over a period of time and tend to break off. Even the springs lose reflexive strength over a period of time as a result of rust forming thereon. None of the prior art has solved the ever present problem of weather weakening the resilience and/or reflexive nature of bamboo-like poles or springs.

One known prior art is a SIGN, U.S. Pat. No. 1,856,349, comprising a base, a support mounted to swing on the base with respect to the horizontal axis, means for yieldably limiting the swinging movement of the support, a sign, and means hingedly connecting the upper portion of the sign to the support.

Another known prior art is a RESILIENT MOUNTING FOR A SIGN POST, U.S. Pat. No. 3,875,720, comprising a ground attached lower section, a separate upper section for carrying the sign and a resilient connection between the upper and lower sections, the resilient section being a bundle of rods securely clamped to one section and relatively loosely attached to the other sections so that the rods can slide relative to each other when the sections are moved temporarily out of alignment upon impact.

Another known prior art is a SELF-REDRESSING SLALOM POLE, U.S. Pat. No. 4,599,012, comprising a standpipe, a ground part to be inserted into the ground and a tipping element arranged between the ground part and standpipe which consists of fiber-reinforced synthetic material.

Another known prior art is a HINGED SLALOM GATE, U.S. Pat. No. 4,636,109, comprising a lower support member adapted to be inserted into the snow, a retractable anchoring member mounted in the support member to retract the gate in an upright position upon being knocked over upon impact.

Another known prior art is a STAND FOR MOTIONABLY MOUNTING ADVERTISEMENTS, U.S. Pat. No. 4,957,258, comprising a foot structure resting on the ground, a mount for advertisements resting on the foot structure by means of a pendulum support having a horizontal swing axis and retractable to an upright position by means of a spring.

Another known prior art is a FLEXIBLE MAILBOX STAND, U.S. Pat. No. 5,029,783, comprising an upper section, a lower section coaxially aligned with the upper section with a spring stretched inside the two sections to urge the two sections towards one another and to urge the upper section to rebound in coaxial alignment with the lower section upon the upper section being impacted.

Another known prior art is a TRAFFIC SIGNALLING POST, U.S. Pat. No. 5,090,348, comprising a flexible rod member, a rigid shaft coaxially secured at one end to the rod member, an anchor bore member adapted to house the shaft for maintaining the latter in a vertical position, the bore member also having an elastic diaphragm.

The prior art over a period of time as disclosed above is definitely susceptible to wearing out because of extended use, of rust forming on the mounts causing the mounts to not reflex upon the signs being impacted, and of freeze up because of inadequate drainage of any water standing on the mounts causing the mounts to become rigid upon the signs being impacted. The function of the present invention is not affected by extended use, rust, or ice. There is a definite need for a mount upon which a sign reflexes upon being impacted regardless of the extended use of the mount, rust accumulated on the mount, or ice formed on the mount during winter weather.

SUMMARY OF THE INVENTION

The present invention relates to a mount for redressably mounting a sign, which comprises an elongate support member having an angled cross section and being disposed in a generally horizontal position relative to the ground with the vertex of the support member directed generally downward and having a bracket member integrally attached or welded at one end thereof for fixedly attaching the mount to a structure such as a bridge. The support member extends inside a tubular rotatable member having generally a square cross section and having open ends, two side walls, a bottom wall, and a top wall with the interior of the top wall resting upon the two longitudinal edges of the support members in a resting position. A clevis member integrally extends from the central portion of the exterior of the bottom wall of the tubular member. A pendulum is pivotally attached with a bolt to the clevis member and depends downwardly therefrom in a swingable fashion with a weighted member fixedly attached to the bottom end of the pendulum to statically arrest a sign in an upright position, the sign being fixedly attached to and extending upwardly from the exterior of the tubular rotatable member.

It is an object of the present invention to provide a mount for redressably mounting a sign which substantially positions a sign in an upright position and which substantially resists swaying back and forth due to the wind impacting the sign.

Another object of the present invention is to provide a mount for redressably mounting a sing which is capable of rotating away from the impact thus substantially reducing the breaking of signs caused by the signs being impacted by farm implements as such crossing over bridges.

Also, another object of the present invention is to provide a mount for redressably mounting a sign, which will substantially last longer and not be adversely affected by the formation of rust thereon.

Yet, another object of the present invention is to provide a mount for redressably mounting a sign which provides a drainage means for water to substantially prevent ice from forming on the mount and freezing the rotatable member so that it won't pivot with the sign being impacted.

Further objects and advantages of the present invention will become more apparent as the description proceeds and when taken in conjunction with the accompanying drawings wherein:

DETAILED DESCRIPTION OF THE INVENTION

Figure 1:
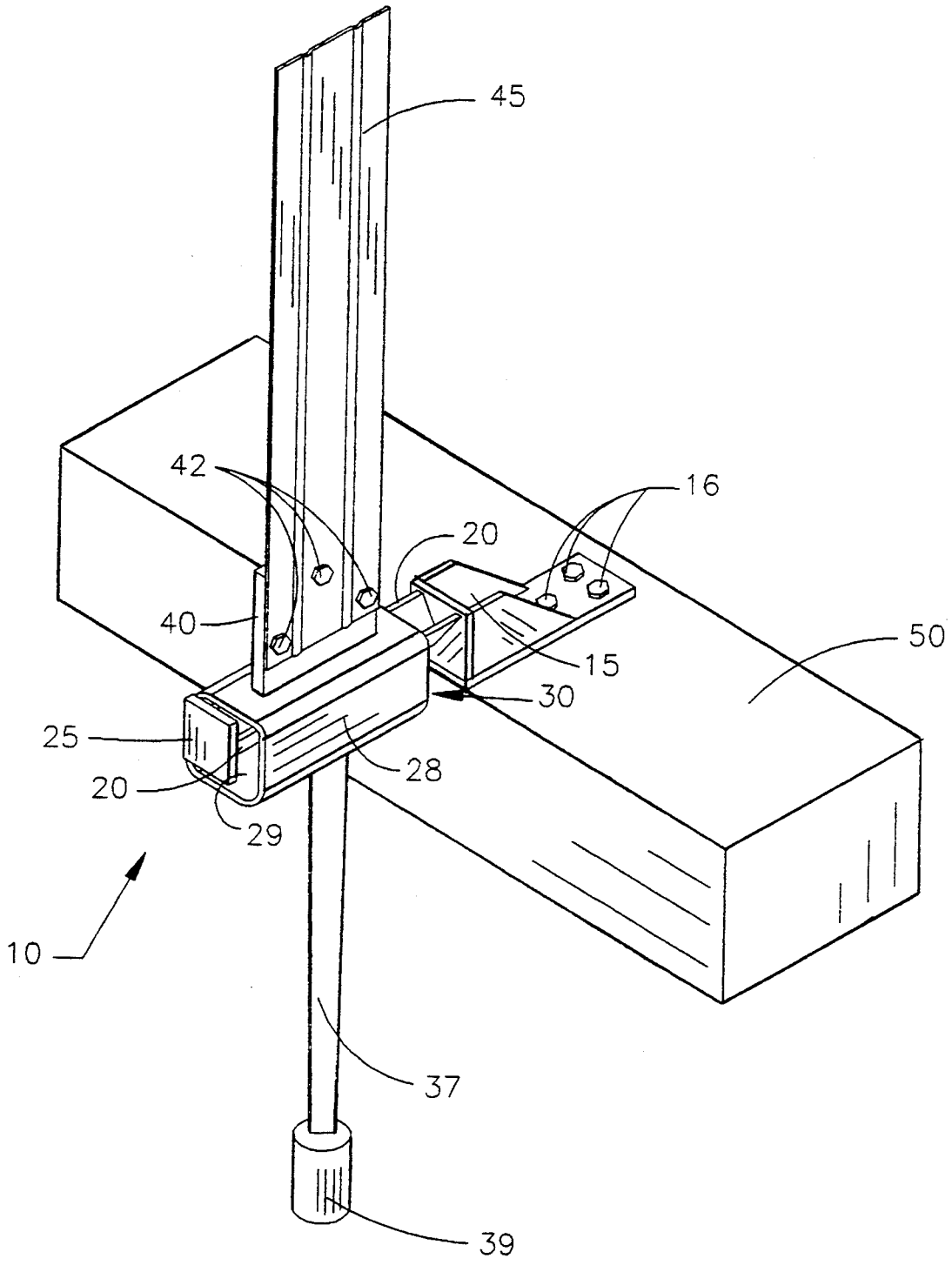
FIG. 1 is a perspective view of the mount with a sign redressably mounted in an upright position thereon.

Referring to the drawings in FIGS. 1 through 5, in particular, the mount for redressably mounting a sign 45 thereon is illustrated as having an elongate support member 20 preferably made of metal and having an angled cross section having essentially a V shape, and fixedly attached or welded at an end thereof to a bracket member 15 which is used to fasten the mount with bolts 16 or other fasteners to a structure 50 such as a bridge or the like. Preferably, the bracket member 15 is fixedly attached to a structure 50 such that the angled support member 20 is disposed in a generally horizontal position relative to the ground with the vertex 21 of the support member 20 disposed downward and the two longitudinal edges 22 and 23 of the support member 20 disposed upward such that the support member 20, when viewed on an end thereof, is essentially an upright V with a trough formed thereupon to essentially allow any water and the like on the support member 20 to drain off the mount and the support member so that, during cold weather, in particular, ice doesn't form on the longitudinal edges 22 and 23 of the support member 20.

Figure 2:
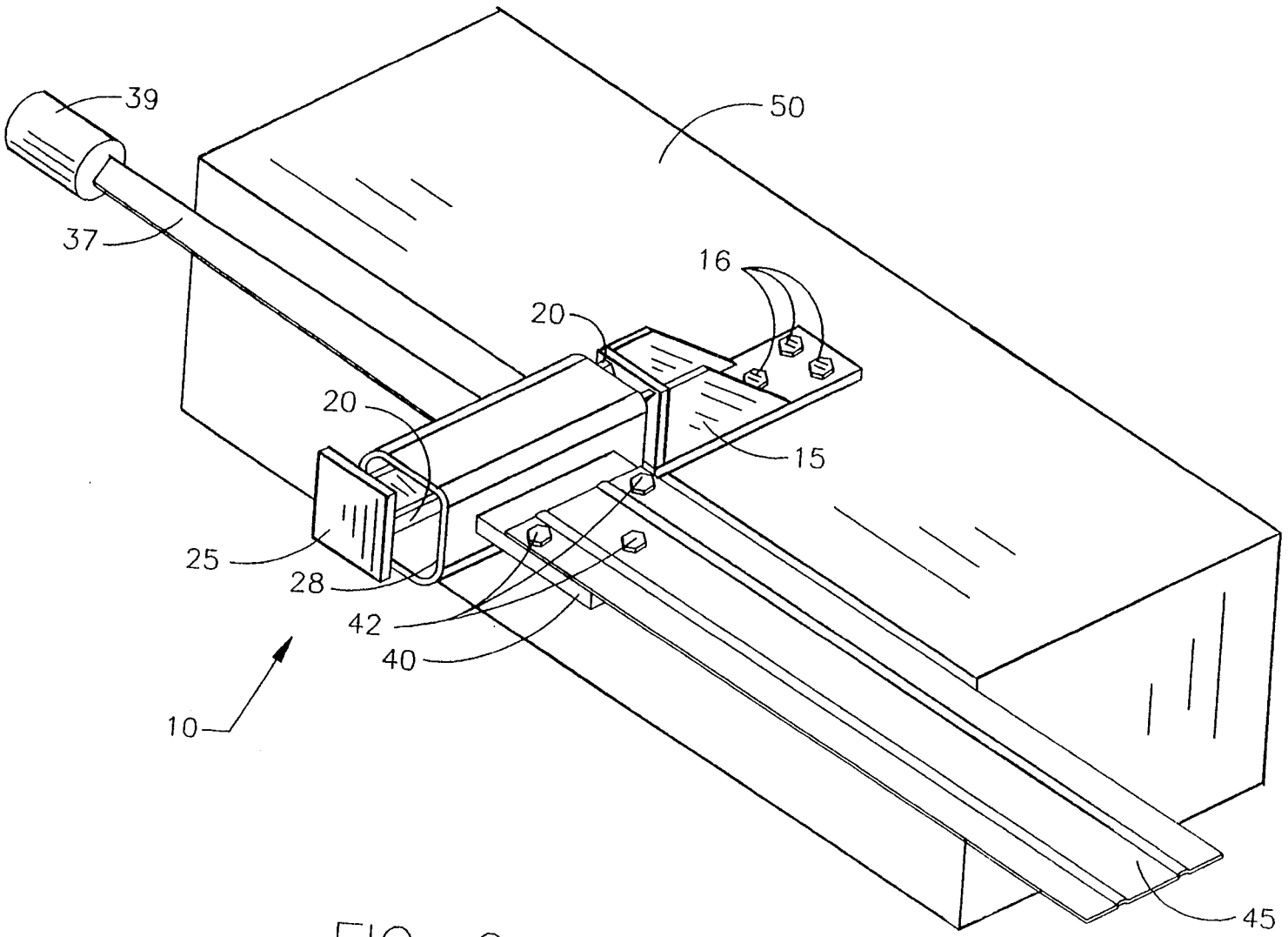
FIG. 2 is a perspective view of the mount with the sign redressably rotated relative to the structure.

As shown in FIGS. 1 and 2, the support member 20 has a planar stop member 25 fixedly attached or welded on its face or surface to the end of the support member 20 opposite the bracket member 15. The vertex 21 of the support member 20 is fixedly attached to the bottom edge of the stop member 25 which extends upwardly beyond the two longitudinal edges 22 and 23 of the support member 20.

As illustrated in FIG. 2, an elongate tubular rotatable member 28 preferably made of metal and having a generally square cross section and having open ends 29 and 30, two side walls 33 and 34, a bottom wall 31 and a top wall 32 is rotatably and coaxially mounted about the support member 20. The rotatable member 28 is rotatable essentially about the longitudinal axis of the support member 20. The interior of the top wall 32 of the rotatable member 28 essentially rests on the two longitudinal edges 22 and 23 of the support member 20 when the rotatable member 28 is in its resting position. The support member 20 extends through the tubular rotatable member 28 such that the stop member 25 is positioned to the outside of one of the open ends 29 of the rotatable member 28. The stop member 25 extends upward above the rotatable member 28 to hold the rotatable member 28 on the support member 20 so that the rotatable member 28 doesn't fall off the support member 20. The stop member 25 is dimensioned to prevent the rotatable member 28 from falling off the support member 20, but also dimensioned to allow the user to remove or slide the rotatable member 28 off the support member 20 for any reason such as to repair or replace the sign 45.

Figure 3:
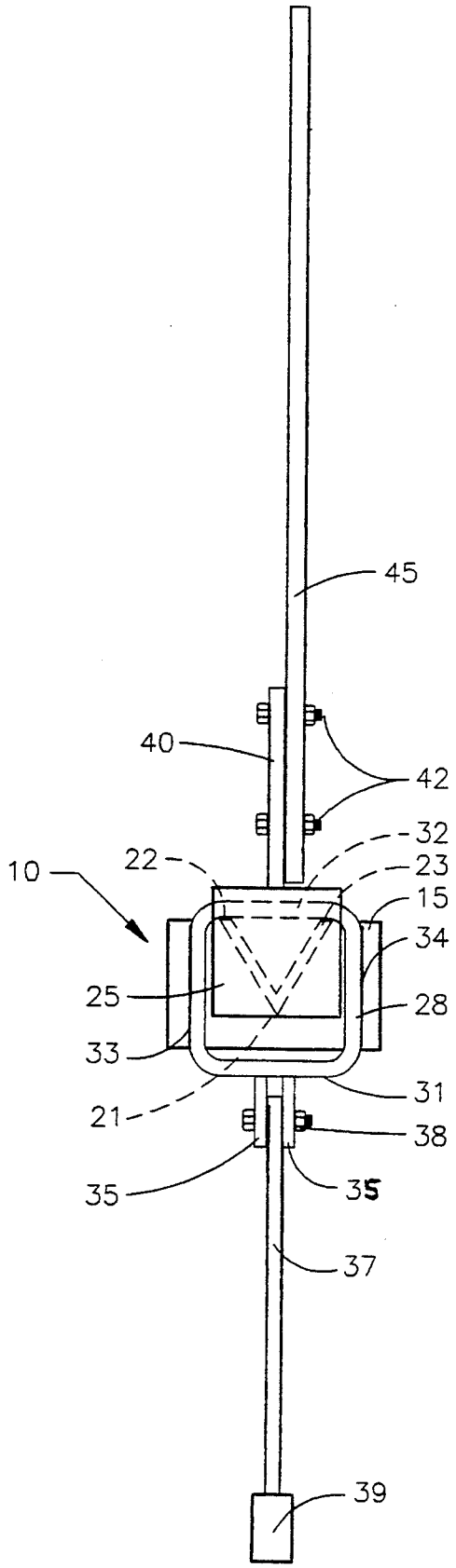
FIG. 3 is a side elevation view of the mount showing the relationship of the angled support member to the rotatable member when the sign is in an upright resting position.
Figure 4:
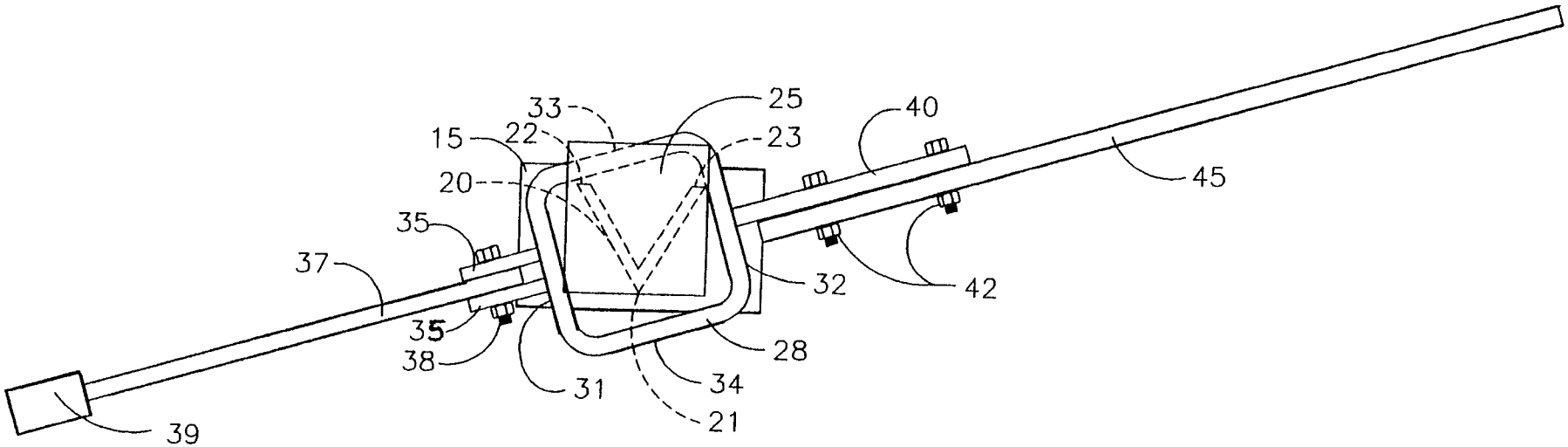
FIG. 4 is a side elevation view of the mount showing the relationship of the angled support member to the rotatable member when the sign is rotated upon being impacted.
Figure 5:
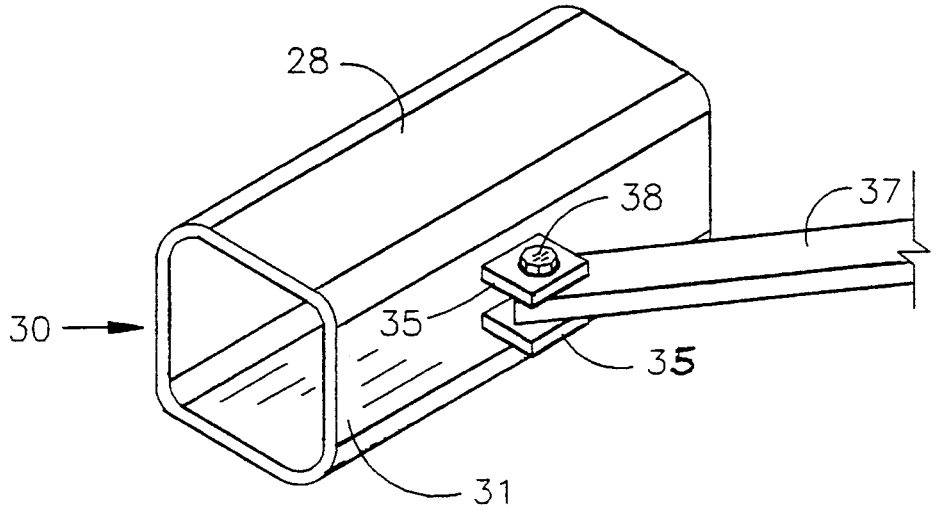
FIG. 5 is a bottom perspective view of the mount showing the pendulum swingably depending downward from the clevis member disposed from the exterior of the bottom wall of the tubular rotatable member.

As shown in FIGS. 3, 4, and 5, a clevis member 35 is centrally disposed upon and depend from the exterior of the bottom wall 31 of the rotatable member 28 to receive a pendulum 37 which has an end mounted with a bolt 38 or the like to the clevis member 35. The pendulum 37 depends downwardly from the rotatable member 28 and can be swung along the longitudinal axis of the rotatable member 28. Further, the pendulum 37 has a weighted member 39 fixedly attached or welded to the bottom end thereof to balance the sign 45, which is mounted upon the rotatable member 28 in an upright resting position. The pendulum 37 is allowed to swing freely from the clevis member 35 independent of the rotatable member 28 so that should the pendulum 37 be impacted by external forces such as a boat passing beneath a bridge upon which the mount is fastened with the pendulum 37 extending downwardly below the bridge, the pendulum 37 will not break off from the mount. The pendulum 37 will swing away from the impact and will return to its resting position because of the weighted member 39 which, through gravitational forces, is continuously seeking equilibrium, when there are no external forces impacting the pendulum 37. Further, the pendulum 37 will swing with the rotatable member 28 when the sign 45 mounted thereon is struck or impacted by external forces. A sign support bracket 40 is fixedly attached or welded to and extends upward from the exterior of the top wall 32 of the tubular rotatable member 28 for fastening the bottom portion of the sign 45 with bolts 42 to the sign support bracket 40 to redressably mount the sign 45 upon the mount, which, if impacted, tends to move away in an arc-like path from the impact causing the tubular rotatable member 28 which is fixedly attached to the sign 45, to rotate with the sign 45 upon the support member 20 causing the pendulum 37 which is generally disposed 180 degrees from the sign 45, to swing upward generally in the same arc-like path as the sign 45.

As illustrated in FIGS. 3 and 4, the tubular rotatable member 28 is dimensioned to receive the support member 20 with the interior of the top wall 32 of the rotatable member 28 essentially resting on the two longitudinal edges 22 and 23 of the angled support member 20. The support member 20 provides two pivot edges which are the two longitudinal edges 22 and 23 upon which the rotatable member 28 rests. If the sign 45 is impacted, the sign 45 moves away in an arc-like manner from the impact causing the rotatable member 28 which is fixedly attached to the sign 45 to restrictively rotate upon the two pivot edges of the support member 20. As the sign 45 and the rotatable member 28 rotate, the pendulum 37, which extends below the rotatable member 28, swings with the rotatable member 28 generally in the same arc-like manner as the sign 45, and will urge the sign 45 back into its upright resting position once the external forces on the sign 45 cease, through the gravitational effects on the weighted member 39 which, because of its weighting generally more than the sign 45, will seek equilibrium or its resting position which is the lowermost position in its arc-like path relative to the rotatable member 28 and the sign 45.

The two pivot edges being the two longitudinal edges 22 and 23 of the support member 20 substantially stabilizes the sign 45 and the rotatable member 28 such that the sign 45 will not generally sway back and forth in the wind as do the prior art, but will remain generally stationary and will only rotate about the two longitudinal edges 22 and 23 when directly impacted by a force greater than the leveraged weight of the weighted member 39 of the pendulum 37. The two longitudinal edges 22 and 23 are spaced apart to sufficiently stabilize and support the rotatable member 28 to substantially prevent the sign 45 from swaying back and forth especially on windy days. The longitudinal edges 22 and 23 generally engage the interior of the rotatable member 28 to not only balance and support the rotatable member 28 thereupon but also to limit or restrict the rotation of the rotatable member 28 upon the sign 45 being impacted by external forces. The rotatable member 28 will not spin uncontrollably about the support member 20 as it would if it were cylindrical shaped, but will instead rotate only as far as necessary to minimize the impact upon the sign 45, because the walls of the rotatable member 28 which has a square cross section will impact the longitudinal edges 22 and 23 of the support member 20 as the rotatable member 28 rotates in response to the sign 45 being impacted and will impede, slow, and essentially stop the rotation of the rotatable member 28 thus allowing the pendulum 37 to counterforce the rotation of the rotatable member 28 to return the sign 45 to its upright resting position when no external forces are present.

Various changes and departures may be made to the invention without departing from the spirit and scope thereof. Accordingly, it is not intended that the invention be limited to that specifically described in the specification or as illustrated in the drawing but only as set forth in the claims.

What is claimed is:

1. A mount for redressably mounting a sign comprising:

a bracket member for mounting said mount to a structure;

an elongate support member having an end fixedly attached to said bracket member and having an angled cross section;

a tubular rotatable member having open ends, a top, bottom, and side walls, said tubular rotatable member being coaxially and rotatably mounted about said support member and upon which said sign is fixedly mounted;

a pendulum swingably depending from said rotatable member, said pendulum having a weighted member attached to an end thereof to generally redress and balance said sign in an upright resting position when external forces are not present.

2. A mount for redressably mounting a sign as described in claim 1, wherein said bracket member is mounted to a structure such that said support member is disposed generally horizontal relative to the ground.

3. A mount for redressably mounting a sign as described in claim 2, wherein said support member is dimensioned to extend through said rotatable member and to allow said rotatable member to rotate upon said support member.

4. A mount for redressably mounting a sign as described in claim 3, wherein said support member has spaced apart longitudinal edges which are disposed through said rotatable member to balance and support said rotatable member thereupon.

5. A mount for redressably mounting a sign as described in claim 4, wherein said support member is disposed so as to form essentially a trough between said longitudinal edges to allow water as such to drain off said mount.

6. A mount for redressably mounting a sign as described in claim 2, wherein said support member has a stop member fixedly attached to an end thereof to generally prevent said rotatable member from falling off said support member.

7. A mount for redressably mounting a sign as described in claim 1, wherein said rotatable member has generally a square cross section.

8. A mount for redressably mounting a sign as described in claim 7, wherein said longitudinal edges are engageable with an interior of said rotatable member.

9. A mount for redressably mounting a sign as described in claim 8, wherein said rotatable member is dimensioned and shaped to restrictively rotate with said sign upon said longitudinal edges in response to said sign being impacted to substantially protect said sign from breakage.

* * * * *